United States Patent [19]

Yamaguti et al.

[11] Patent Number: 4,545,228

[45] Date of Patent: Oct. 8, 1985

[54] ROLL ECCENTRICITY CONTROL SYSTEM FOR A ROLLING APPARATUS

[75] Inventors: Terushige Yamaguti, Nabari; Toshinori Miki, Izumisano; Toshio Mannaka, Katsuta; Hiroshi Koyama, Hitachi; Yukihiro Kawano, Katsuta, all of Japan

[73] Assignees: Hitachi, Ltd.; Nisshin Steel Co., Ltd., both of Tokyo, Japan

[21] Appl. No.: 551,911

[22] Filed: Nov. 15, 1983

[30] Foreign Application Priority Data

Nov. 15, 1982 [JP] Japan ..... 57-198939

[51] Int. Cl.[4] ..... B21B 37/00

[52] U.S. Cl. ..... 72/16; 72/8

[58] Field of Search ..... 72/8, 11, 16

[56] References Cited

U.S. PATENT DOCUMENTS 3,920,968 11/1975 Imai et al. ..... 72/8

4,036,041 7/1977 Ichiryu ..... 72/8

4,038,848 8/1977 Ichiryu ..... 72/8

*Primary Examiner*—Lowell A. Larson

*Assistant Examiner*—Jorji M. Griffin

*Attorney, Agent, or Firm*—Antonelli, Terry & Wands

[57] ABSTRACT

A roll eccentricity control system for rolling apparatus in which a period of each cycle corresponding to one revolution of the roll is divided into a plurality of sections, a deviation in thickness of the rolled material in each section is sampled during the rolling operation, the sampled deviations in the respective sections for at least one period are averaged to determine a period average deviation and the deviations sampled during plural periods are averaged separately for the respective sections to determine section average deviations of the respective sections which are stored as basic data, the period average deviation is subtracted from the section average deviations and the resultant differences for the respective sections are stored as basic patterns, the basic data and the basic pattern stored for each section are readout at a suitable timing to be used for producing a reduction position control signal for that section, which is adapted to compensate the thickness variation of the rolled material when rolled under that section.

6 Claims, 8 Drawing Figures

FIG. 1
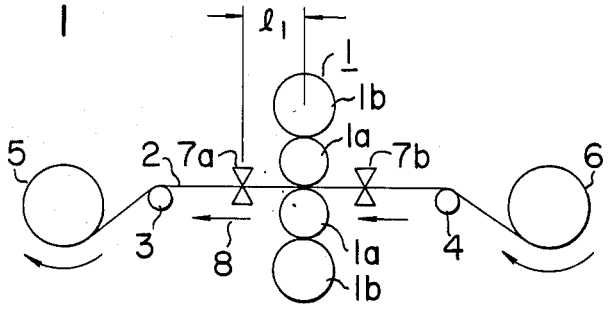
FIG. 2
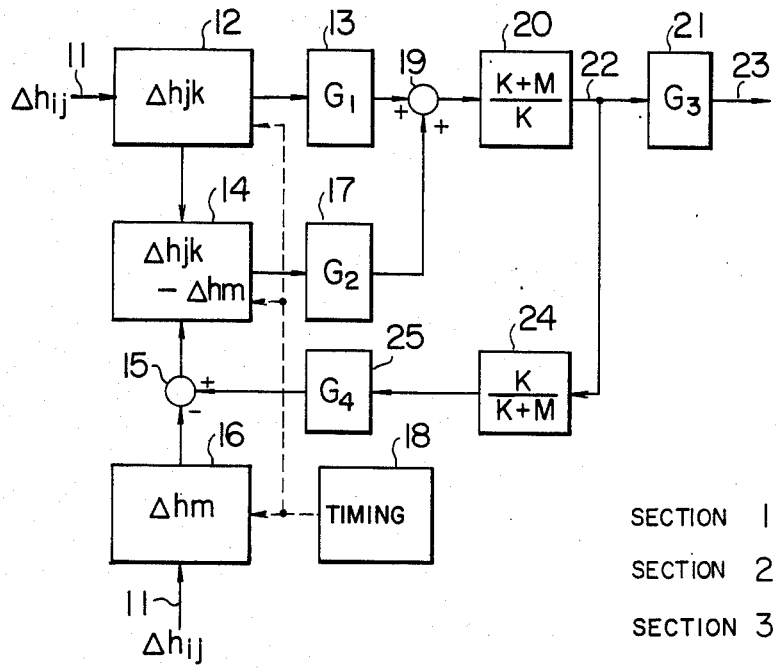
FIG. 3
| | |
|---|---|
| SECTION 1 | $\Delta h_{1k} - \Delta hm$ |
| SECTION 2 | $\Delta h_{2k} - \Delta hm$ |
| SECTION 3 | $\Delta h_{3k} - \Delta hm$ |
| | ⋮ |
| SECTION n | $\Delta h_{nk} - \Delta hm$ |
| | ⋮ |
| SECTION p | $\Delta h_{pk} - \Delta hn$ |
| | ⋮ |
| SECTION j | $\Delta h_{jk} - \Delta hm$ |

ROLL ECCENTRICITY CONTROL SYSTEM FOR A ROLLING APPARATUS

BACKGROUND OF THE INVENTION

1. Field of the Invention

The present invention relates to a roll eccentricity control system for a rolling apparatus, and more particularly to a roll eccentricity control system suitable for compensating a variation of thickness of a web material due to a roll eccentricity in a gauge control of a rolling apparatus for rolling a web material such as a hot rolling mill, a cold rolling mill or the like.

2. Description of the Prior Art

The rolls used in a rolling apparatus, such as a rolling mill for rolling a steel plate, do not have sections of exact true circle due to grinding accuracy (unevenness in grinding) in the manufacture of the rolls. In a rolling mill of a type in which the rolls are coupled to rotary shafts by keys, the keys are necessarily causes of roll eccentricity. Because of the roll eccentricity, a roll gap periodically varies at a period of one revolution of the roll. This causes a periodic variation of the thickness of the plate as rolled.

Several control methods have been proposed to prevent the variation of the plate thickness due to the roll eccentricity. One of well known methods is a programmed control method using off-line data, as disclosed in U.S. Pat. No. 4,038,848 issued on Aug. 2, 1977 to Ken Ichiryu et al and entitled "Method and Apparatus for Controlling Eccentricity of Rolls in Rolling Mill", in which a variation of a rolling load is detected while the rolls are rotated under a suitable rolling pressure but which no material to be rolled and stored as a data for indicating the roll eccentricity, and a variation of the roll gap due to the eccentricity during the rolling operation is compensated based on the store data.

The control unit which uses the programmed control method is generally useful, but has several problems in some cases. First, a roll rotation angular position sensor is required to store an eccentricity detection signal in correspondence to respective angular positions in one revolution of the roll. The sensor may be a pulse generator or selsyn generator. Such a rotation sensor is desired to be located as closely to a roll shaft as possible in order to enhance a detection accuracy. However, because of a mechanical structure around the roll, a circumstance (high temperature, oil mist, etc.) and a mounting structure of a rotation transmission mechanism, it is difficult to mount the sensor satisfactorily close to the roll shaft and hence difficult to detect the rotational position reliably with good reliability and good linearity in relationship between its output and the rotational position. Even if the close mounting is possible, it makes a roll exchange work which is frequently conducted troublesome. Further, in preparing the prestored compensation signal for thickness variation due to the roll eccentricity, it is necessary to warm up the rolls to a temperature near to a roll temperature which is encountered during the actual rolling process. Since such a roll temperature is relatively high, a time of 10–15 minutes is usually required to warm up the rolls and prepare the roll eccentricity compensation signal. Further, because of a difference from an actual rolling condition, an error necessarily occurs between the actual roll eccentricity and the stored data by various causes. Accordingly, there is a limit in the improvement of the gauge precision by this method.

A method for resolving the problems encountered in the above programmed control method has been proposed, for example, in U.S. Pat. No. 4,036,041 issued on July 19, 1977 to Ken Ichiryu et al and entitled "Gauge Control System for Rolling Mill", in which a variation of the plate thickness is measured by a load meter during the actual rolling operation, a resulting signal is processed by a correlation circuit or a filter circuit to produce an eccentricity component representing the roll eccentricity, and the plate thickness is corrected by controlling the rolling pressure in accordance with a rotational position detection signal.

In the control unit which uses this method, the measured signal from the load meter is statistically frequency-analyzed. Since a back-up roll is usually repeatedly used after scratches formed on the surface thereof during the rolling operation have been ground away, a diameter of an old roll may be 10–20% smaller than the diameter of a new one. As a result, a basic frequency of the frequency analysis varies and a center frequency of the filter circuit is shifted. Accordingly, an apparent detection gain is lowered and an exact roll eccentricity cannot be recognized. Further, the variation of the rolling load does not always exactlly represent the roll eccentricity. Especially, in case of the automatic gauge control of the gauge meter type in which the equivalent rigidity of the rolling stand may be greatly increased, the load signal includes components due to various factors other than the roll eccentricity. Therefore, there is a limit in controlling the roll eccentricity by this signal.

SUMMARY OF THE INVENTION

It is an object of the present invention to provide a roll eccentricity control system which determines a correction signal for compensating a variation in thickness of rolled material due to a roll eccentricity during a rolling operation and controls a rolling pressure by the correction signal to reduce the thickness variation.

In the roll eccentricity control system of the present invention, a period of each cycle corresponding to one revolution of the roll of the rolling apparatus is divided into a plurality of sections, a deviation of the thickness of the rolled material in each section is sampled during the rolling operation, deviations in the respective sections sampled in at least one period are stored, the deviations in the sections in at least one period are averaged to determine a period average deviation, the deviations sampled during plural periods are averaged separately for the respective sections to determine section average deviations of the respective sections, which are stored as basic data, the period average deviation is subracted from the section average deviations and the resultant differences for the respective sections are stored as basic patterns, the basic data and the basic pattern for the section of the roll which is positioned to apply the rolling pressure to the rolled material are read out and combined to produce a roll eccentricity control signal for the respective section, the roll eccentricity control signal is converted to a reduction position signal in accordance with characteristics of the rolling apparatus and the rolled material, and a pressure-applying device is controlled by the reduction position signal to precisely compensate for thickness variation of the rolled material due to the roll eccentricity.

In a preferred aspect of the present invention, the stored basic pattern of the section corresponding to the reduction position signal is corrected based on the reduction position signal to compensate a control error due to other factors including a difference between diameters of upper and lower rolls.

BRIEF DESCRIPTION OF THE DRAWINGS

FIG. 1 shows a schematic construction of a rolling apparatus to which the present invention is applied, FIG. 2 is a block diagram of a control circuit in accordance with one embodiment of the present invention, FIG. 3 shows a content of a basic pattern memory used in the circuit of FIG. 2.

DESCRIPTION OF THE PREFERRED EMBODIMENTS

Figure 4:
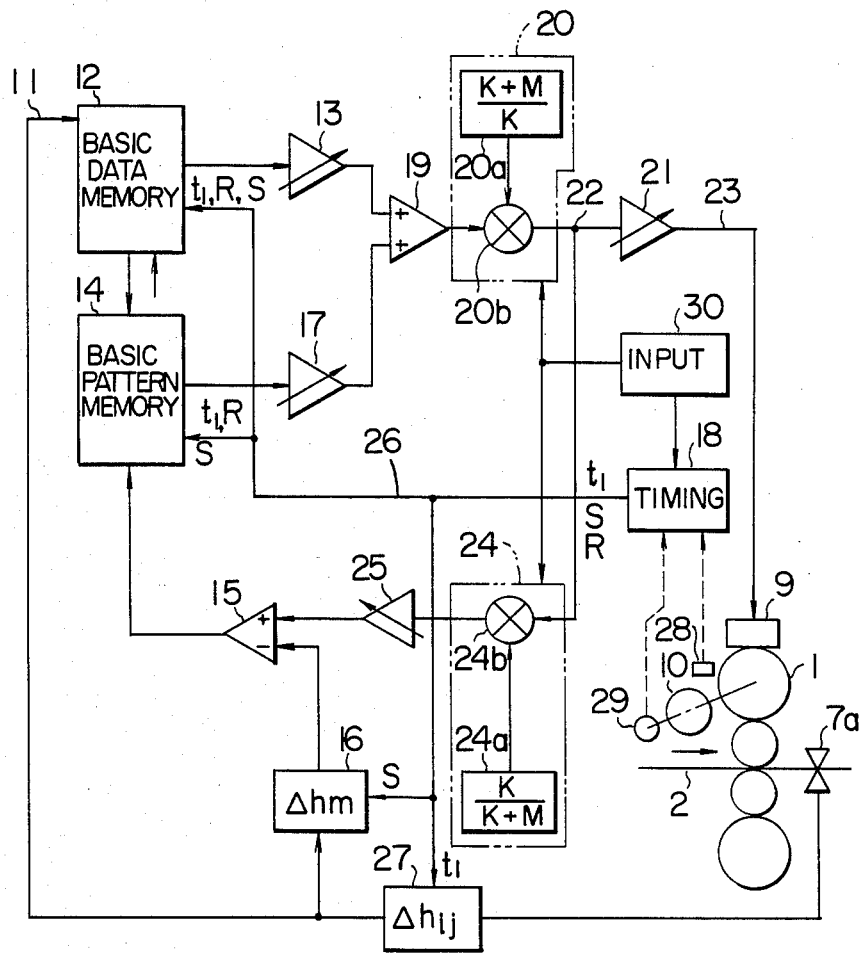
FIG.4 shows an arrangement in which the embodiment of FIG. 2 is applied to the rolling apparatus of FIG. 1.

In a conventional rolling operation, a variation in thickness of the raw material to be rolled is substantially eliminated after being rolled by a known automatic gauge control. Accordingly, it is considered that the variation in thickness of the material as rolled is mainly due to a roll eccentricity. The thickness variation due to the roll eccentricity has a periodicity whose one cycle period is corresponding to one revolution of the roll and it has been found that it has a characteristic which cannot be approximated by a simple function such as a sine function. Further, the thickness variation actually measured contains components due to factors other than the roll eccentricity. Accordingly, in the present invention, one period corresponding to one revolution of the roll is divided into a plurality of sections, i.e. j sections ($j>1$), a deviation of the thickness is sampled in each section j during the rolling operation, a basic data for the roll eccentricity control is prepared for each section based on the sample, an average of the sampled thickness deviations in one period is calculated, and the basic data is corrected by the average to prepare the roll eccentricity control signal for each section.

The application of the present invention to a rolling mill shown in FIG. 1 is now described. It should be understood, however, that the present invention is applicable to various other rolling apparatus than that shown in FIG. 1.

The rolling mill shown in FIG. 1 is of reversible type. The rolling stand 1 comprises upper and lower work rolls 1*a* and upper and lower backup rolls 1*b*. A web material 2, such as steel plate, to be rolled is inserted into a gap between the upper and lower work rolls 1*a*, and both ends of the material are wound on a left reel 5 and a right reel 6 through deflection rolls 3 and 4, respectively. Thickness gauges 7*a* and 7*b* for detecting a deviation of the thickness of the plate 2 are arranged in inlet and outlet sides of the roll stand 1.

In the rolling mill of FIG. 1, the thickness gauges 7*a* and 7*b* are provided to start the measurement of the deviation of the thickness of the rolled material 2 at any timing during the operation of the rolling mill. As described above, an appropriate known AGC system (not shown) is incorporated and the variation in thickness of the raw material to be rolled is substantially eliminated by the AGC system. Accordingly, it can be considered that the variation of the plate thickness measured by the thickness gauges 7*a* and 7*b* is mainly due to the roll eccentricity. In order to define the period of one revolution of the roll, a proximity switch (not shown) is mounted on a backup roll chock and a metal member is attached to a roll neck of the backup roll 1*b* to face the proximity switch. Thus, when the metal member approaches to the proximity switch most closely, the proximity switch is pulsively closed so that the start point in each period of the rotation of the backup roll 1*b* is determined. At the timing when the proximity switch is closed, the sampling is started from the output of the thickness gauge 7*a* at the outlet of the rolling mill, assuming that the plate 2 is running in a direction of the arrow. As will be explained later, one period corresponding to one revolution of the backup roll 1*b* is divided into j sections starting from the point at which the proximity switch is closed, and a timing signal for sampling is generated at the leading point of each section and the output of the thickness gauge 7*a* is sampled in response to the timing signal. Accordingly, in the i-th period of the rotation of the backup roll, section deviations of the plate thickness $\Delta h_{i1}, \Delta h_{i2}, \ldots \Delta h_{ij}$ are sampled sequentially for the respective sections 1, 2, . . . j, and they are stored. The stored section deviations are used to prepare a roll eccentricity control signal as will be explained later. Since a high frequency noise may be introduced in the samples, it is preferable to store samples in a plurality of periods, i.e. k periods. Since the sampling continues so long as the control is to be continued, the stored samples are sequentially updated so that the samples in the latest k periods are always stored, and the roll eccentricity control signal is prepared based on those samples. The value of j is at least 8 and preferably 15–30, and k is preferably 3–5.

The detected section deviations in the i-th, (i+1)-th, (i+2)-th, . . . (i+k−1)-th periods are;

$$\begin{array}{l} \Delta h_{i1}, \Delta h_{i2}, \ldots \Delta h_{ij}, \\ \Delta h_{(i+1)1}, \Delta h_{(i+1)2}, \ldots \Delta h_{(i+1)j}, \\ \vdots \\ \Delta h_{(i+k-1)1}, \Delta h_{(i+k-1)2}, \ldots \Delta h_{(i+k-1)j} \end{array}$$

and they are stored in a section deviation memory.

Then, averages of the deviations in the respective sections are calculated as follows.

$$\begin{array}{l} \Delta h_{1k} = \{\Delta h_{i1} + \Delta h_{(i+1)1} + \Delta h_{(i+2)1} + \ldots \Delta h_{(i+k-1)1}\}/k \\ \Delta h_{2k} = \{\Delta h_{i2} + \Delta h_{(i+1)2} + \Delta h_{(i+2)2} + \ldots \Delta h_{(i+k-1)2}\}/k \\ \vdots \\ \Delta h_{jk} = \{\Delta h_{ij} + \Delta h_{(i+1)j} + \Delta h_{(i+2)j} + \ldots \Delta h_{(i+k-1)j}\}/k \end{array}$$

to prepare section average deviations for the respective sections, i.e. $\Delta h_{1k}, \Delta h_{2k}, \ldots \Delta h_{jk}$, as basic data.

The basic data contains components of thickness deviations due to factors other than the roll eccentricity such as a setting error of the roll gap and the variation in properties of the material. These components are regarded as being substantially constant during several rotations of the backup roll and, hence, can be represented by an average of the thickness deviations detected during k revolutions of the backup roll or a fraction thereof. In order to eliminate those components, the section average deviations fo the j sections are averaged to calculate a period average deviation $$\Delta h_m = \sum_{j=1}^{j} \Delta h_{jk}/j$$

and it is substracted from the respective section deviations of the basic data. The resulting differences $(\Delta h_{1k}-\Delta h_m)$, $(\Delta h_{2k}-\Delta h_m)$, . . . $(\Delta h_{jk}-\Delta h_m)$ are stored as an eccentricity control basic pattern. The $\Delta h_m$ may be calculated based on the section average deviations in any one period.

The roll eccentricity control is effected based on the basic data and the basic pattern thus prepared. One embodiment of the present invention is now explained with reference to FIG. 2 which shows a control block diagram thereof.

As shown in FIG. 2, the section deviation $\Delta h_{ij}$ is sequentially applied to a basic data generation memory 12 through a line 11 and the basic data $\Delta h_{ik}$ is calculated thereby and stored therein. The basic data $\Delta h_{jk}$ is supplied to a multiplier 13 which multiplies a control gain $G_1$ and to a basic pattern generation memory 14. The period average deviation $\Delta h_m$ is applied to the basic pattern generation memory 14 from a period average deviation calculation memory 16 through a substractor 15. The basic pattern generation memory 14 calculates $(\Delta h_{jk}-\Delta h_m)$ and stores the resulting difference. The generated basic pattern is supplied to a multiplier 17 which multiples a control gain $G_2$. The basic pattern is stored in an arithmetic register in the basic pattern generation memory 14 as shown in FIG. 3. Each section of the register corresponds to the section j on the circumference of the roll and the continuous section 1 to j of the register correspond to one revolution of the roll. The basic data generation memory 12 also has a register having sections 1 to j in which $(\Delta h_{jk}-\Delta h_m)$ are stored. The basic data and the basic pattern are continuously updated by new data and pattern uppon receiving a timing signal from a timing unit 18, and the contents of the registers are read out to the multipliers 13 and 17 by a read signal as described later. The output signals of the multipliers 13 and 17 are summed by an adder 19 and the resulting sum is applied to a signal converter 20 as a roll eccentricity control signal.

The basic data determines a basic amount to control the roll eccentricity and the basic pattern determines a correction amount. Proportions thereof are determined by the multipliers 13 and 17. For example, when the basic amount is 50% and the correction amount is 50%, $G_1$ is set to 0.5 and $G_2$ is set to 0.5. The values of $G_1$ and $G_2$ may be experimentarily determined, where $G_1+G_2=1$.

The signal converter 20 multiplies a reciprocal of a pressing influence coefficient, i.e. K+M/K to the output signal of the adder 19. Since the output of the adder 19 represents the roll eccentricity control amount in the form of the deviation of the output thickness of the material, the signal converter 20 converts it to a corresponding reduction control amount. In the reciprocal function, K is a spring constant of the rolling stand and M is an elastic coefficient of the material. They are previously calculated in accordance with the well-known rolling theoretical formulas. The output signal of the signal converter 20 is supplied to a pressure-applying device (not shown) as a reduction signal through a multiplier 21 which multiplies a control gain $G_3$ so that the variation of the plate thickness due to the roll eccentricity is reduced.

The roll eccentricity control is started upon the completion of the preparation of the basic pattern, that is, from the (i+k)-th period. Accordingly, the timing for the correction control is not shifted, the phase of the start point of the control is not retarded and the on-line control is attained. The read timing for the basic data and the basic pattern must be controlled to read out the contents of the section of the registers corresponding to the roll section which is positioned to apply the rolling pressure to the material. Accordingly, the read timing must be determined by taking into consideration of the delay of the detection timing of the thickness deviation from the rolling timing and the delay in response of the control system. For example, in the rolling mill shown in FIG. 1, when the rolling is done in the direction of the arrow 8, the roll 1 is displaced from the thickness gauge 7*a* by $l_1$ as expressed by a transport distance of the rolled material 2. Further, there exists a control response delay corresponding to a distance $l_2$ given by a product of the control response delay time of the system including the pressure-applying device and the thickness gauge and the rolling speed. Accordingly, in order to read out the roll eccentricity control signal in correspondence to the roll section which is at the pressure-appling position, the following control is made. Assuming that the content of the section 1 of the register shown in FIG. 3 corresponds to the portion of the rolled material existing at the location of the thickness gauge. Thus, the section n which is $l_1$ downstream thereof corresponds to the portion of the material which is now subjected to rolling process. In order to compensate the delay corresponding to $l_2$, the content of the section p which is $l_2$ downstream of the section n must be read out. The value of $l_1$ is constant for a given rolling mill but the value of $l_2$ varies with the rolling speed. Accordingly, the correction correlated to the rolling speed is required.

In this manner, the roll eccentricity control amount is corrected by the basic pattern in a time sequence without causing the shift of the timing. It is also necessary to compensate the beat due to a difference between the diameters of the upper and lower rolls and the synchronization shift due to the quantumization error in counting of each section during the sampling. This compensation is attained in the embodiment of FIG. 2 by multiplying the pressing influence coefficient K/(K+M) to the reduction position signal 22 by a signal converter 24, multiplying a feedback gain $G_4$ to the output signal of the signal converter 24 by a multiplier 25 and integrally feeding back the output signal of the multiplier 25 to the basic pattern generation memory 14 through the substractor 15. Namely, the period average deviation $\Delta h_m$ is subtracted from the output signal of the multiplier 25 to calculate an actual pattern, which is algebraically added to the basic pattern (integration control) to minimize the actual deviation of the plate thickness.

Since the variation of the plate thickness due to the various factors described above eventually causes the output signal of the signal converter 20 which represents the reduction control amount, the feed forward control mode is adapted so that the basic pattern is corrected by the output signal of the signal converter 20. The coefficient $G_4$ may be experimentarily determined.

In the above synchronization shift compensation means, the output of the multiplier 25 instead of the output of the substractor 15 may be supplied to the basic pattern generation memory 14.

A configuration of the rolling mill which incorporates the control circuit of FIG. 2 is shown in FIG. 4, in which the like elements to those shown in FIG. 1 or 2 are designated by the like numerals and they are not explained here.

In FIG. 4, the detection signal for the thickness gauge *7a* is supplied to a deviation detector/section deviation memory 27, and the output signal 11 from the memory 27 is supplied to the basic data generation memory 12 and the period average deviation calculation memory 16. The operaton timing of the memory 27 is controlled by a write timing signal $t_1$ supplied from the timing unit 18. Applied to the timing unit 18 are a start point signal from a proximity switch 28 disposed closely to the roll 1, a section timing signal corresponding to the section j from a pulse generator 29 coupled to a rotary shaft of a drive motor 10 of the roll 1, and the parameters relating to the rolling mill and the rolled material such as the distance $l_1$, the values K and M, the response delay time Ts of the control system and the length $l_0$ of the material corresponding to the above-mentioned one section from an input device 30.

Figure 5:
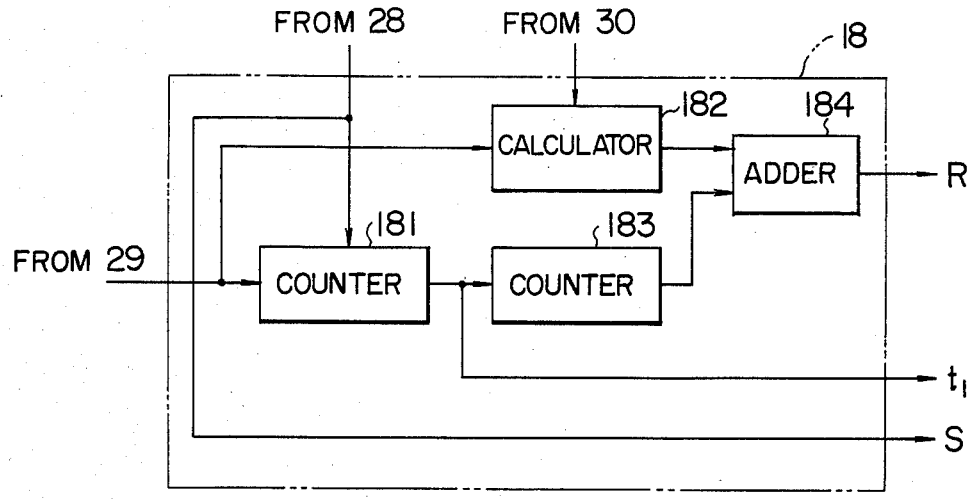
FIG. 5 is a block diagram of a timing unit.

The timing unit 18 may be constructed as shown in FIG. 5. A counter 181 is reset by the start point signal from the proximity switch 28 and counts pulses from the pulse generator 29. The counter 181 overflows when it has counted the pulses corresponding to one section of the j sections of one roll revolution, and an overflow signal is used as the write timing signal $t_1$. A calculator 182 calculates $$\frac{l_1 + T_s \cdot V_s}{l_0}$$

based on the rolling speed Vs(m/sec) obtained by the input pulse frequency from the pulse generator 29, and $l_0$(m), $l_1$ (m) and the response delay Ts (sec) of the control system supplied from the input device 30. The value of $$\frac{l_1 + T_s \cdot V_s}{l_0}$$

corresponds to the value of $(l_1+l_2)$ represented in unit of the roll section. A counter 183 counts the output of the counter 181, i.e. the write timing pulse $t_1$. An adder 184 sums the count of the counter 183 and the output of the calculator 182 to produce a sum R. The sum R is used to specify the read address of the basic data generation memory 12 and the basic pattern generation memory 14. The signal from the proximity switch 28 is produced as a start point signal S. The counter 183 overflows when the count of the signal $t_1$ reaches the number of section j. When the sum of the adder 184 exceeds j, it produces an excess of j. This is, the sum assumes j+1, j+2, . . . , the adder 184 produces 1, 2, . . . . In order to prevent the j-th timing signal $t_1$ from the counter 181 from producing simultaneously with the start point signal S, the counter 181 overflows by the number of pulses equal to the number of pulses generated by the pulse generator 29 for one revolution of the roll less several pulses (as a margin for the generation of the start point pulse), divided by j.

Referring again to FIG. 4, the signal converters 20 and 24 comprise setters 20*a* and 24*a* and multipliers 20*b* and 24*b*, respectively. The setters 20*a* and 24*a* calculate K+M/K and K/K+M′ respectively, based on the values K and M supplied from the input device 30 to set the multipliers for the multipliers 20*b* and 24*b*.

Figure 6:
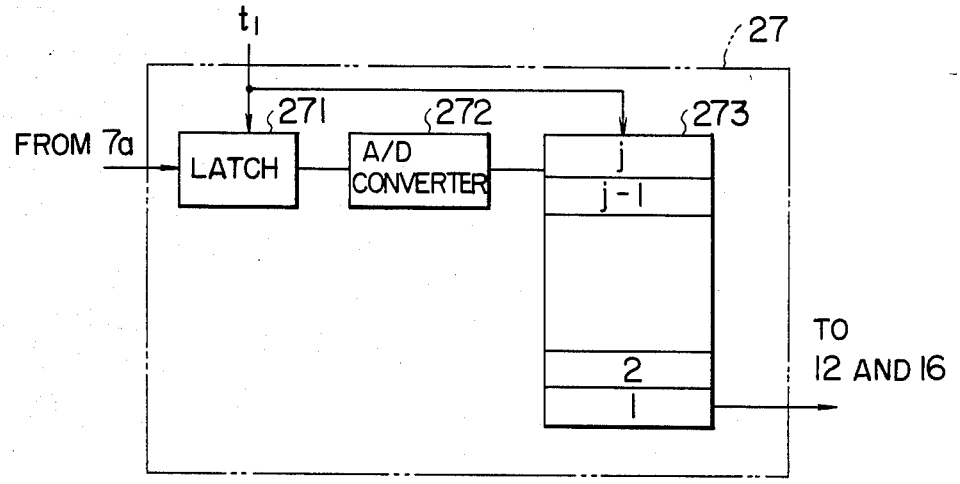
FIG. 6 is a block diagram of a section deviation memory.

The section deviation memory 27 may be constructed as shown in FIG. 6. The plate thickness deviation Δh from the thickness gauge *7a* is supplied to a latch circuit 271, which latches the deviation by the timing signal $t_1$ and supplied it to an A/D converter 272. The A/D converter 272 converts the input deviation Δh to a digital value and it is stored in a section j of a shift register 273. The contents of the section j, j-1, . . . 2 of the shift register 273 are shifted to the sections j-1, j-2, . . . 1, respectively, by the timing signal $t_1$, and the content of the section 1 is transferred to the basic data generation memory 12 and the period average deviation calculation memory 16.

Figure 7:
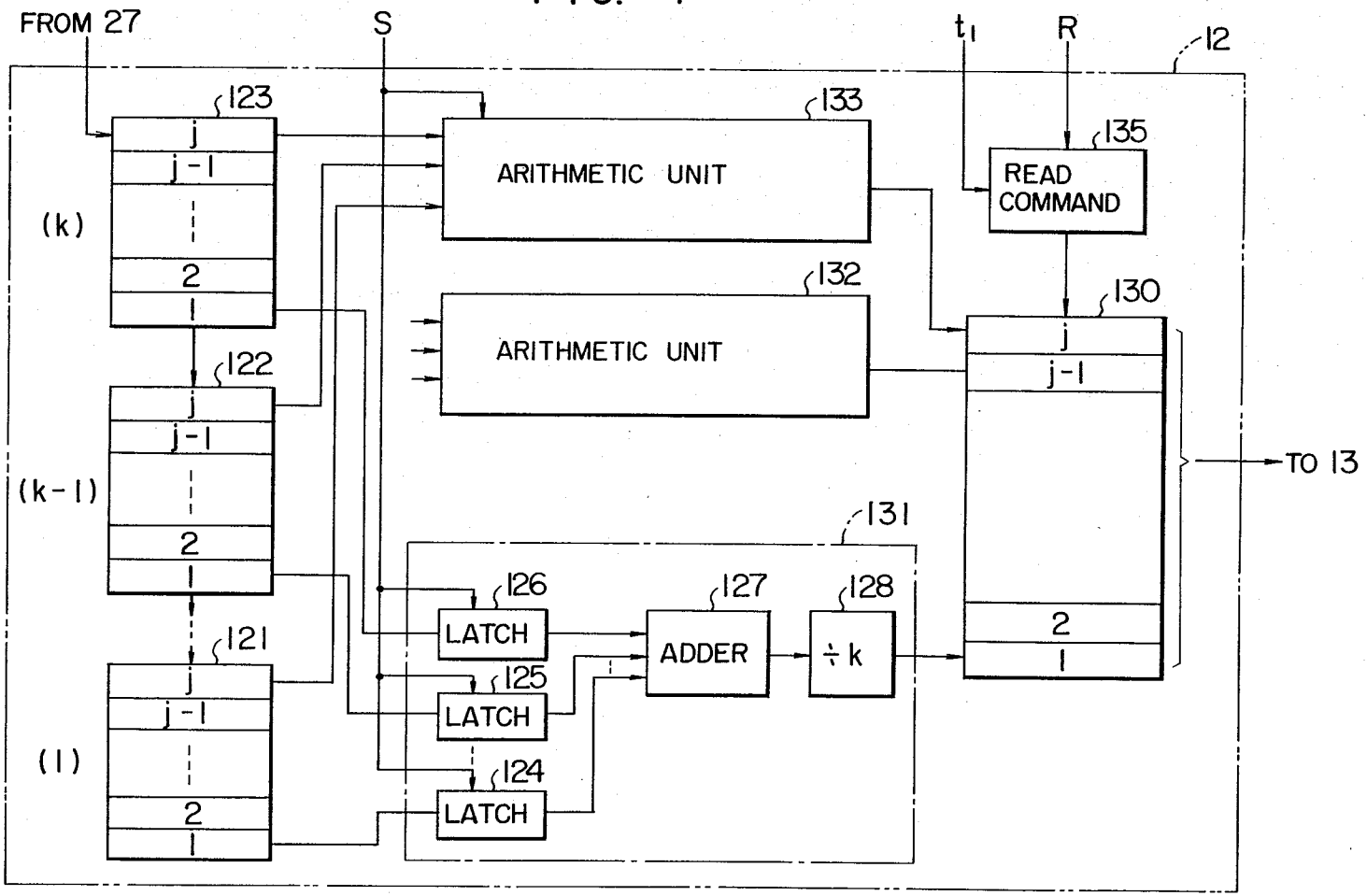
FIG. 7 is a block diagram of a basic data generation memory.
Figure 8:
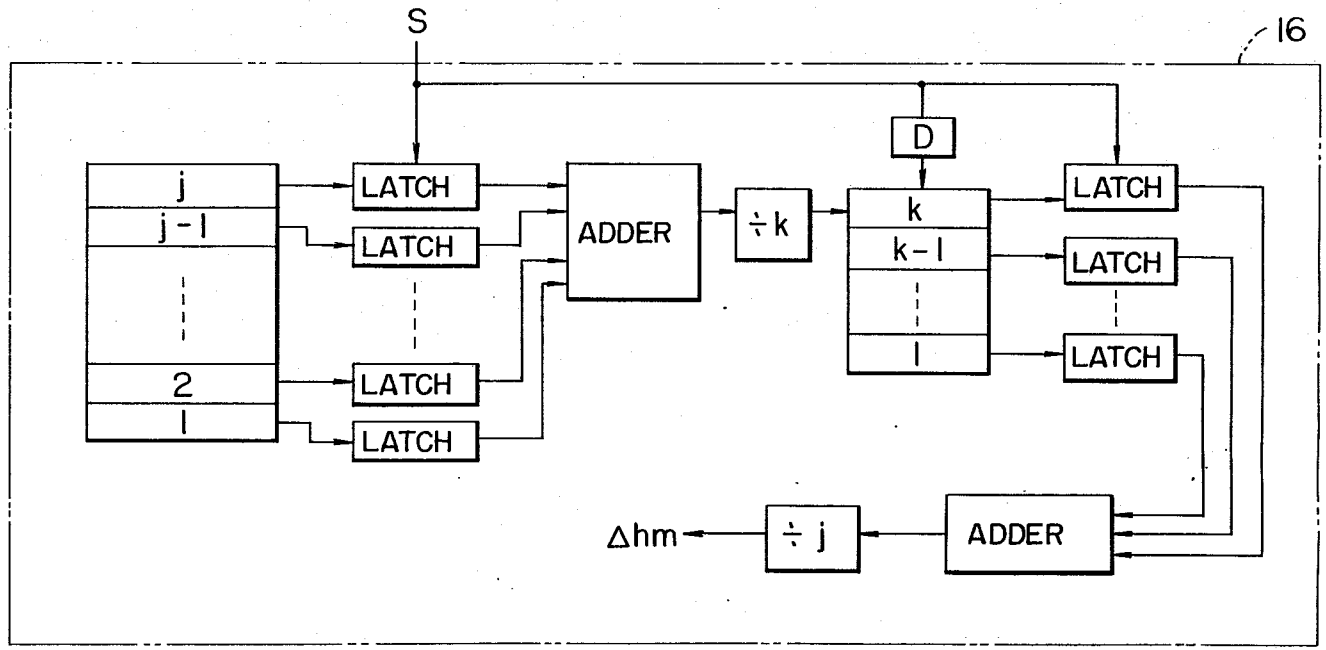
FIG. 8 is a block diagram of a basic pattern generation memory.

The basic data generation memory 12 is constructed as shown in FIG. 7. The data transferred from the section 1 of the register of the section deviation memory 27 is stored in a section j of a shift register 123, and at the next timing signal t-hd 1, it is shifted to the section (j-1) and the next transferred data is stored in the section j. The data overflow from the shift register 123 is transferred to a register 122. While only three registers are shown in FIG. 7, k shift registers are provided when the k-period data are used. Accordingly, the registers are full when the k-period data have been transferred. The contents of the corresponding sections of the respective shift registers are applied to arithmetic units 131, 132 and 133, respectively, where averages are calculated and they are stored in corresponding sections of a memory 130. A construction of only the arithmetic unit 131 is shown in FIG. 7. At the timing of the start point signal S, the contents of the sections 1 of the respective shift registers are latched in latches 124, 125 and 126, respectively, the outputs thereof are summed by an adder 127, the sum is divided by k by a divider 128 and the quotient is stored in an addressible section 1 of the memory 130. The arithmetic units 132 and 133 are similarly constructed and calculate averages, which are stored in the addressible sections 2, 3, . . . j of the memory 130. At the timing of the timing signal $t_1$, a read command is issued from the read command circuit 135 and the content of the section of the memory 130 specified by a signal R from the timing unit 18 is read out and it is supplied to the multiplier 13.

The basic pattern generation memory 14 comprises a conventional subtractor and a memory having addressible sections 1 to j. It calculates $(\Delta h_{jk} - \Delta hm)$ for each section based on $\Delta h_{jk}$ for each section supplied from the basic data generation memory 12 and $\Delta h_m$ supplied from the period average deviation memory 27, and the resulting differences are stored in the corresponding sections of the memory. The readout of the data from the memory is done in the same manner as that of the basic data generation memory.

The data thus read form the basic data generation memory 12 and the basic pattern generation memory 14 are processed in the manner shown in FIG. 2 to produce the pressing position signal 23 to control the pressing amount of the pressing device 9.

While a hardware configuration is shown in FIG. 4, the entire system may be implemented by a stored logic using a control computer. Further, a hybrid system which uses a control computer as the setters 20*a* and 24*a*, for example, may be used.

The means for detecting the deviation of the plate thickness is not limited to the thickness gauge 7*a* of the embodiment but it may be any means capable of detecting the plate thickness or the deviation of the plate thickness. For example, a well-known rolling load meter may be used to detect a load or a load deviation corresponding to the plate thickness or the plate thickness deviation.

As described hereinabove, according to the present embodiment, the thickness deviation of the rolled material is on-line detected in correspondence to the circumferential position of the roll, and the pressing position of the roll is controlled based on the detected deviation. Accordingly, it is not necessary to arrange the precise rotational position sensor as the roll eccentricity detection means closely to the roll, and the variation of the plate thickness due to the roll eccentricity is on-line compensated with a high precision and without reguard to the deformation of the roll by grinding.

Further, in accordance with the present embodiment the beat due to the difference between the diameters of the upper and lower rolls and the synchronization shift due to the quantumization errors of the count in one section in detecting the thickness are compensated and more precise roll eccentricity control is attained.

Furthermore, the present embodiment does not compete with the existing apparatus and does not need high precision maintenance.

Although the present invention has been described in a case where the invention is applied to a rolling mill for steel plate, it will be appreciated that the present invention can be applied to any rolling apparatus for rolling web material other than steel plate to reduce its thickness.

We claim:

1. A roll eccentricity control system for compensating a variation of output thickness of a rolled material due to a roll eccentricity in a rolling apparatus in which the output thickness is controlled by controlling a roll gap of the rolling apparatus in accordance with a reduction position signal, said system comprising;

thickness deviation detection means for detecting a deviation of the output thickness of the rolled material from a desired value thereof;

means for sequentially sampling and storing, during rolling operation of the apparatus, deviations of the output thickness of the rolled material for a plurality of sections which are devisions of one cycle period corresponding to one revolution of said roll;

means for sequentially calculating period average deviations based on averages of the deviations of the thickness sampled for at least one period and storing the period average deviations for the respective sections;

means for calculating differences between section average deviations for the respective sections derived from averages of the deviations of the thickness, for the corresponding sections, sampled for a plurality of periods and stored as basic data and period average deviations for the respective sections, and storing the differences for the respective sections as a basic pattern;

means for reading out values of said basic data and said basic pattern for the respective sections, sequentially in order of the sections, at a controlled timing and combining said read-out values to produce roll eccentricity control signals for the respective sections; and means for converting said roll eccentricity control signals for the respective sections to reduction position control siganls for the respective sections in accordance with characteristics of said rolling apparatus and said rolled material, said reduction position control signals being utilized for controlling the roll gap of said rolling apparatus so as to control the output thickness of said rolled material.

2. A roll eccentricity control system according to claim 1 wherein said roll eccentricity control signal for each of the sections is derived by summing a product of the value of the basic dtea for the corresponding section and a predetermined first coefficient and a product of the value of the basic pattern for the corresponding section and a second predetermined coefficient.

3. A roll eccentricity control system according to claim 1 wherein said reduction position control signals are derived by multiplying a pressing influence coefficient to said roll eccentricity control signals.

4. A roll eccentricity control system according to claim 3 wherein said pressing influence coefficient is $K/(K+M)$, where K is a spring constant of said rolling apparatus and M is an elastic coefficient of said rolled material.

5. A roll eccentricity control system according to claim 1 wherein said controlled timing is determined by a timing signal generated by a timing unit, said timing unit including a proximity switch located on a circumference of said roll to detect a base point, a counter for counting pulses produced from a pulse generator driven in association with said roll and generating a timing signal when its count reaches a value corresponding to one section in rotation of said roll and means for producing a read command at a timing determined in accordance with a displacement between a rolling position and a thickness detection position and a control delay of the system.

6. A roll eccentricity control system according to claim 1 further comprising means for correcting said basic pattern for the respective sections by said roll eccentricity control signals.

* * * * *